US009504631B2

(12) United States Patent
Cudworth et al.

(10) Patent No.: US 9,504,631 B2
(45) Date of Patent: Nov. 29, 2016

(54) TEETHER

(75) Inventors: Nicholas Cudworth, Pittington (GB); Arnold Rees, Newcastle Upon Tyne (GB)

(73) Assignee: Jackel International Limited, Cramlington, Northumberland (GB)

( * ) Notice: Subject to any disclaimer, the term of this patent is extended or adjusted under 35 U.S.C. 154(b) by 466 days.

(21) Appl. No.: 13/518,720

(22) PCT Filed: Dec. 21, 2010

(86) PCT No.: PCT/EP2010/070431

§ 371 (c)(1),
(2), (4) Date: Jul. 26, 2012

(87) PCT Pub. No.: WO2011/076815

PCT Pub. Date: Jun. 30, 2011

(65) Prior Publication Data

US 2012/0283774 A1 Nov. 8, 2012

(30) Foreign Application Priority Data

Dec. 23, 2009 (GB) ..... 0922607.7

(51) Int. Cl.
*A61J 17/02* (2006.01)

(52) U.S. Cl.
CPC ..... *A61J 17/02* (2013.01)

(58) Field of Classification Search
CPC .... A61J 17/00; A61J 17/02; A61J 2017/001; A61J 2017/006; A61J 2017/008; A61H 13/00
USPC ..... 606/234–236; 119/71, 709–711; 215/11.1–11.6; 128/857, 859, 860, 128/861, 862
See application file for complete search history.

(56) References Cited

U.S. PATENT DOCUMENTS

| | | | | | |
|---|---|---|---|---|---|
| 516,561 | A * | 3/1894 | Bosch | 606/235 |
| 1,235,169 | A * | 7/1917 | Tallon | 606/236 |
| 4,986,751 | A * | 1/1991 | Bergersen | 433/6 |
| 5,062,422 | A * | 11/1991 | Kinkade | 128/207.14 |
| 5,305,741 | A * | 4/1994 | Moles | 128/207.14 |
| 5,334,218 | A * | 8/1994 | Johnson | 606/235 |
| 5,720,302 | A * | 2/1998 | Belfer | 128/848 |
| 5,814,074 | A * | 9/1998 | Branam | 606/234 |
| 5,865,170 | A * | 2/1999 | Moles | 128/201.26 |
| 6,454,788 | B1 * | 9/2002 | Ashton | 606/234 |
| 6,536,424 | B2 * | 3/2003 | Fitton | 128/200.24 |
| 6,966,319 | B2 * | 11/2005 | Fitton | 128/848 |

(Continued)

FOREIGN PATENT DOCUMENTS

| | | |
|---|---|---|
| WO | 03065969 | 8/2003 |
| WO | 2007028971 | 3/2007 |

OTHER PUBLICATIONS

International Search Report, Apr. 12, 2011.

(Continued)

*Primary Examiner* — David C Eastwood

(74) *Attorney, Agent, or Firm* — Olson & Cepuritis, Ltd.

(57) ABSTRACT

A teether is provided for infant use. The teether comprises an exterior portion and a mouthpiece wherein the mouthpiece includes a substantially U-shaped biting section comprising first and second arms extending from a central portion. At least part of said central portion is resiliently collapsible upon application of pressure thereto during use of the teether by an infant.

29 Claims, 8 Drawing Sheets

(56) References Cited

U.S. PATENT DOCUMENTS

| | | | | |
|---|---|---|---|---|
| 7,798,146 | B2 * | 9/2010 | Witt et al. | 128/206.29 |
| 8,597,235 | B2 * | 12/2013 | Lo | 604/77 |
| 2003/0083696 | A1 * | 5/2003 | Avital | 606/234 |
| 2003/0163162 | A1 * | 8/2003 | Uehara et al. | 606/234 |
| 2003/0176891 | A1 * | 9/2003 | Frederic | 606/234 |
| 2005/0080456 | A1 * | 4/2005 | Sanbrook et al. | 606/235 |
| 2005/0119699 | A1 * | 6/2005 | Sari | 606/234 |
| 2005/0261739 | A1 * | 11/2005 | Chen | 606/234 |
| 2009/0076548 | A1 * | 3/2009 | Letsche | 606/235 |
| 2010/0016895 | A1 * | 1/2010 | Eisenberg et al. | 606/234 |
| 2011/0160769 | A1 * | 6/2011 | Tesini et al. | 606/235 |

OTHER PUBLICATIONS

Written Opinion of the International Searching Authority, Apr. 12, 2011.

* cited by examiner

TEETHER

BACKGROUND INFORMATION

When babies or infants are growing or "cutting" new teeth, it often leads to painful gums and general discomfort. Teethers are well known devices for offering relief for babies who are cutting new teeth by providing hard or semi hard surfaces for them to bite and chew on. A variety of teether shapes and designs are known in the art.

Generally, the biting surface of known teethers is U-shaped in order to match the profile of an infant's teeth and gums. The U-shaped biting surface is inserted into the infant's mouth and a handle, flange or other formation protrudes outside the mouth for safe insertion and removal of the teether.

One known teether is the "Gummy" teether, which is described in EP 1471869, Bellett Leasing Pty Limited. The Gummy teether has a U-shape biting surface which is wider and thicker at the extremities than at the axial centre of the U-shape, in the vicinity of the infant's front teeth. Different profiles of biting surface may be provided according to different embodiments of the Gummy teether, dependent on the age of the infant and thus the extent of development of the infant's teeth.

There are various problems associated with prior art teethers. As with the Gummy teether described above, prior art teethers are often designed so that different embodiments or product types are suitable for different respective development stages, according to the teeth that are protruding through the infant's gums. For example, usually the front incisor teeth are the first teeth to appear, with teeth further back in the mouth coming later. Therefore a U-shaped teething surface with uniform thickness is only useful for very early stages of development, before the front teeth have emerged. Once the front teeth have already grown into place, it is more suitable to use a soother embodiment which is thicker towards the back of the mouth than at the front, so that the infant's ability to bite on the teether at the back of the mouth is not impeded by the front teeth that have already formed.

It will be appreciated that using several different teethers during different development stages of an infant's teeth is inconvenient and cost ineffective. Furthermore, it is difficult to select the precise profile of teether that would be appropriate for an infant at any given point of their teeth development.

The invention is set out in the claims.

Because the mouthpiece of the teether includes a substantially U-shaped biting section having a central portion, wherein at least part of said central portion is resiliently collapsible upon application of pressure thereto during use of the teether by an infant, a flexible and variable teether is provided. If the infant has already developed teeth in the front of his or her mouth, in the vicinity of the central portion during use of the teether, at least part of the central portion will collapse in order to accommodate those front teeth whilst still enabling the infant to bite down on the rear portions formed by the arms of the U-shaped biting section. Because at least part of the central portion is resiliently collapsible, it will return to its uncollapsed state when the pressure thereon is released.

By providing a hollow formation in the central portion of the mouthpiece, resilient collapsibility can be achieved. The formation will not collapse merely due to being hollow, but will require some force or pressure to be applied thereto by infant teeth or gums. Therefore the teether is effective both for very early stages of tooth development when an infant has no front teeth, and in later stages when the front teeth are partly or fully developed.

By providing a support ring between the substantially U-shaped biting section and the exterior portion of the teether, a secure method of attaching the mouthpiece to the exterior portion is achieved. This is important to ensure that the mouthpiece does not become dislodged and form a choking hazard. Furthermore, since the support ring is made form a more rigid material than the substantially U-shaped biting section, the overall robustness and safety of the teether is enhanced.

By providing a layer of flexible material forming a surface of the teether against an infant's face during use, enhanced comfort is provided. Furthermore, by providing a groove, flex channel or undulation within the flexible material, improve flexibility and accommodation of infant mouth movement is provided.

Because the U-shaped biting section may comprise a protrusion, indentation or groove on the surface thereof, enhanced massaging and comforting effects are provided for the infant's gums.

By forming the exterior portion of the teether from a relatively rigid material, a secure anchor is provided for the teether, outside the infant's mouth, which cannot be swallowed by the infant. By providing holes in the exterior portion, this rigidity and resistance to collapse is combined with the goal of safely reducing hardness against the infant's face.

Hence a user friendly, safe and flexible teether is provided, which can be used during various stages of infant development to provide relief from discomfort for teething infants.

FIGURES

Embodiments will now be described, by way of example, with reference to the drawings, of which:

Figure 4A:
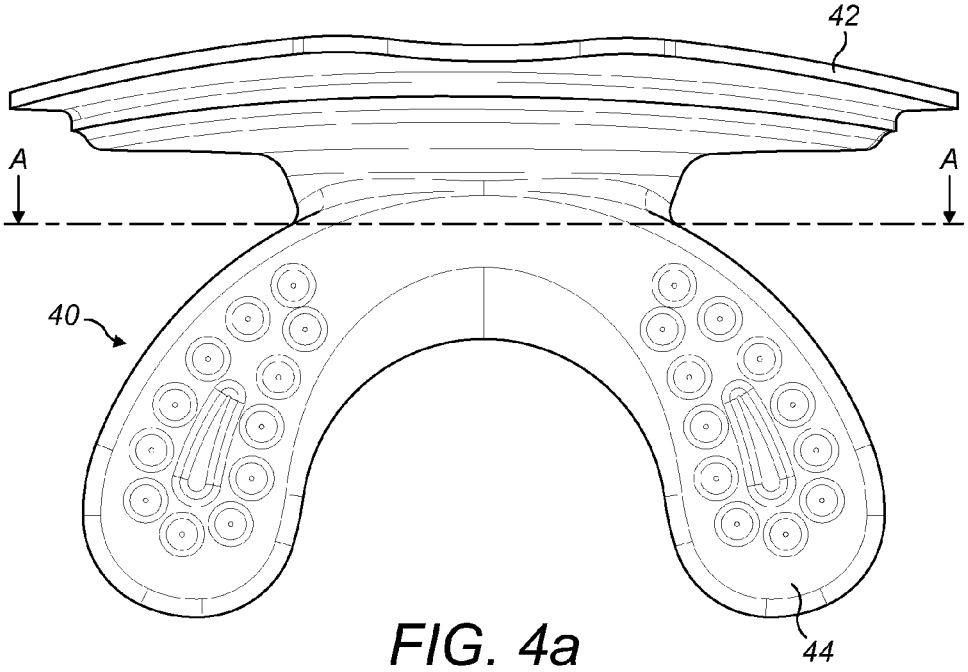
Figure 4B:
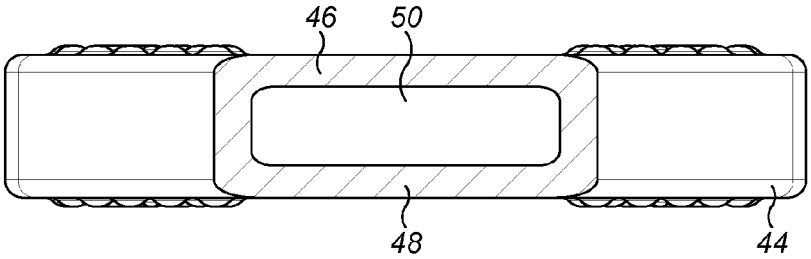
Figure 4C:
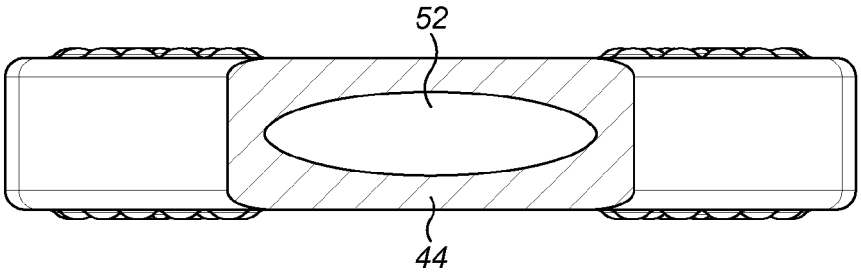

FIG. 4*a* shows a plan view of a teether according to an embodiment;

FIG. 4*b* shows a cross-section through the teether of FIG. 4*a* along line AA therein;

FIG. 4*c* shows an alternative cross-section along line AA in FIG. 4*a;*

Figure 4D:
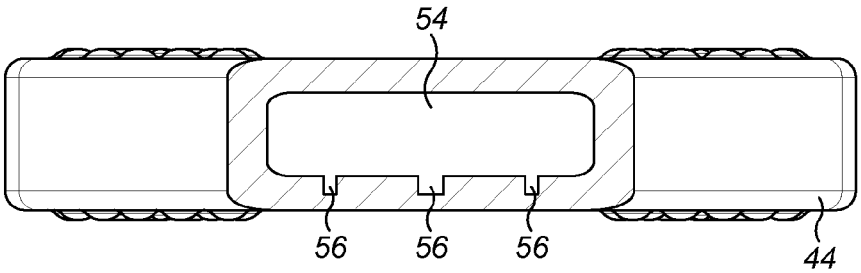
Figure 4E:
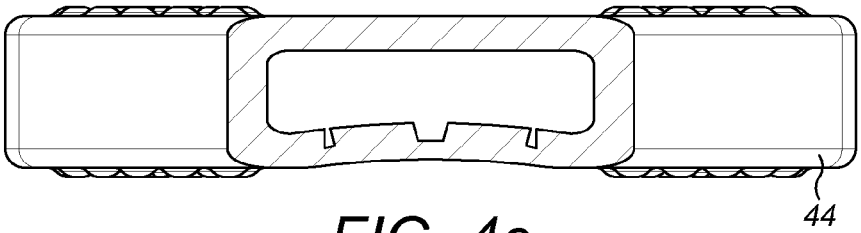
Figure 4F:
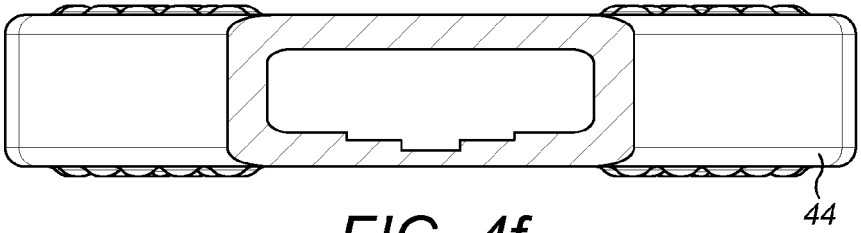

FIG. 4*d* shows another alternative cross-section along line AA in FIG. 4*a*, including grooves;

FIG. 4*e* shows the embodiment shown in FIG. 4*d* with a compression force applied thereto;

FIG. 4*f* shows an alternative cross-section along line AA in FIG. 4*a;*

Figure 5A:
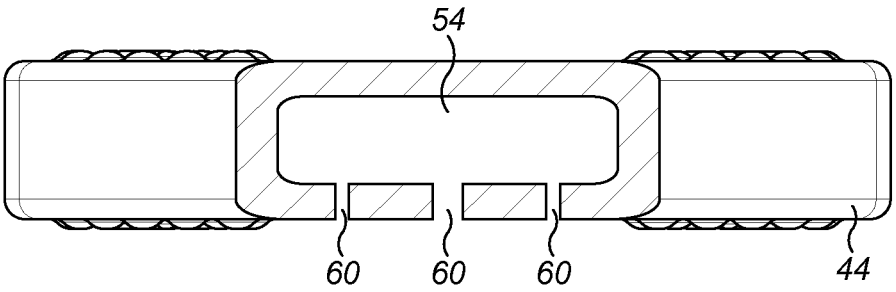
Figure 5B:
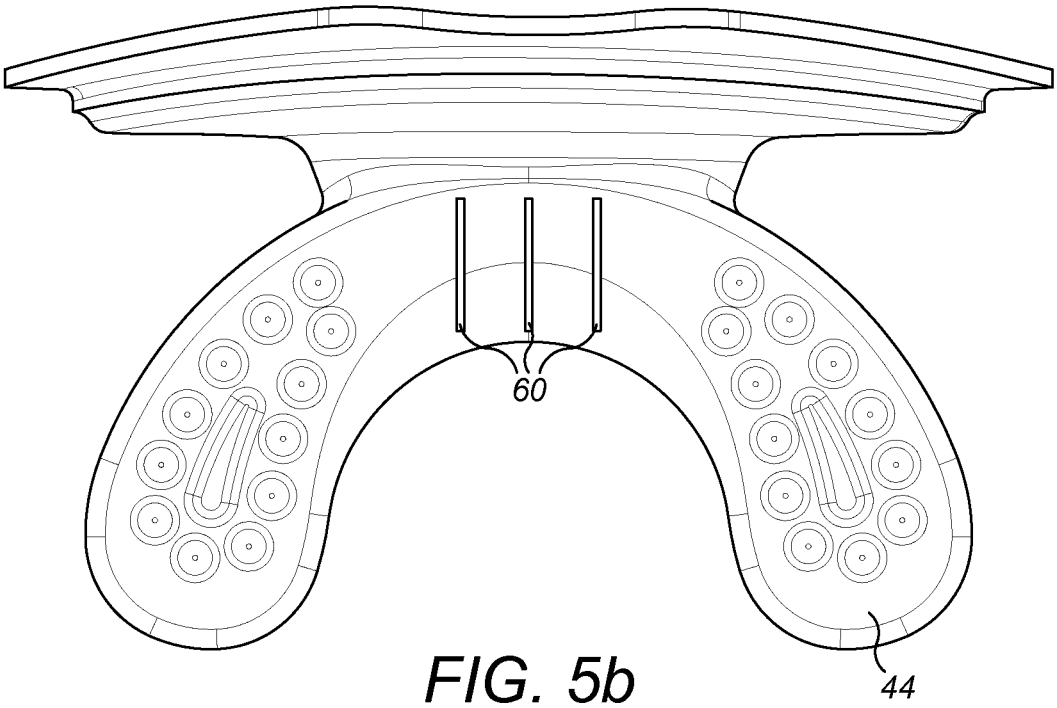

FIG. 5*a* shows another possible cross-section along line AA in FIG. 4*a*, with slits therein;

FIG. 5*b* shows the view from underneath of the teether embodiment shown in FIG. 5*a;*

Figure 6:
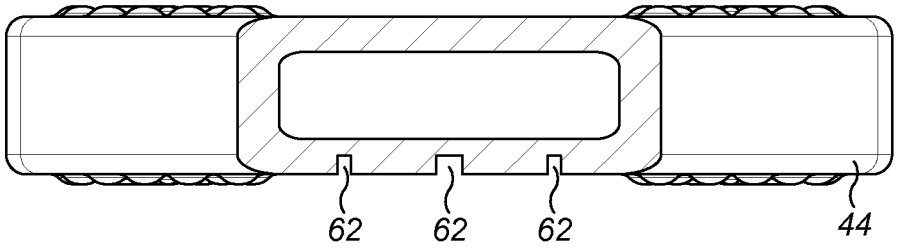
Figure 7:
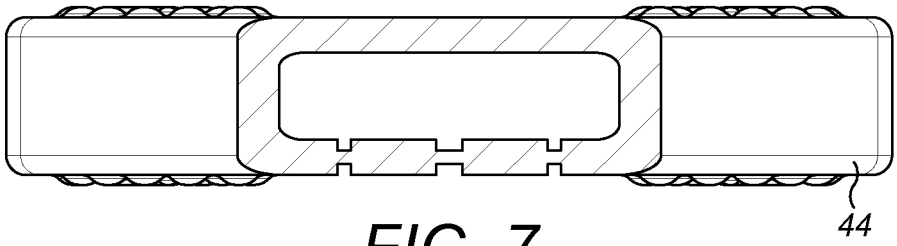
Figure 8:
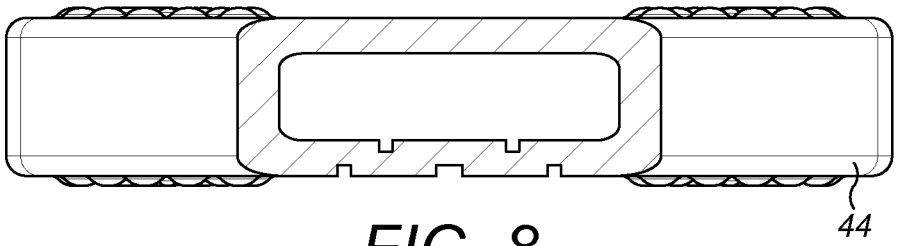
Figure 9A:
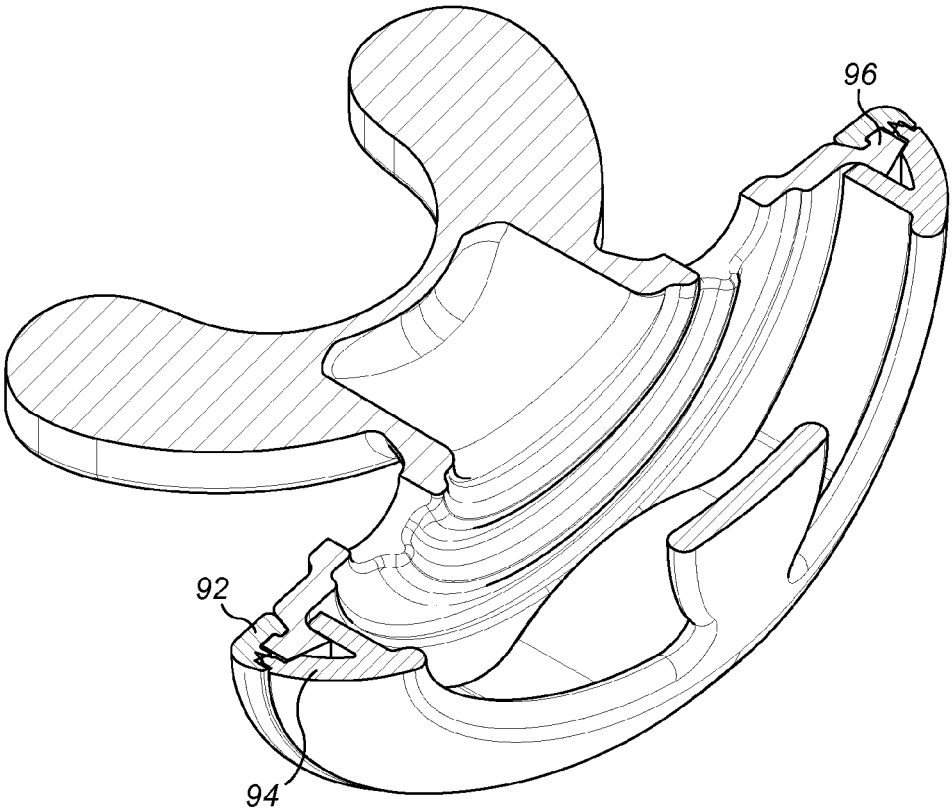
Figure 9B:
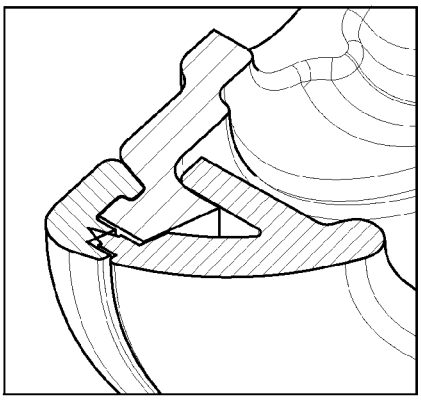

FIG. 6 shows another alternative cross-section along line AA in FIG. 4*a* with grooves on an outer surface of the teether mouthpiece;

FIG. 7 shows another alternative cross-section along line AA in FIG. 4*a* with grooves on inner and outer surfaces;

FIG. 8 shows another alternative cross-section along line AA in FIG. 4*a* with misaligned grooves;

FIG. 9*a* shows a cross-section through a three-part teether according to an embodiment;

FIG. 9*b* shows a close-up view of a portion of the teether shown in FIG. 9*a;*

Figure 9C:
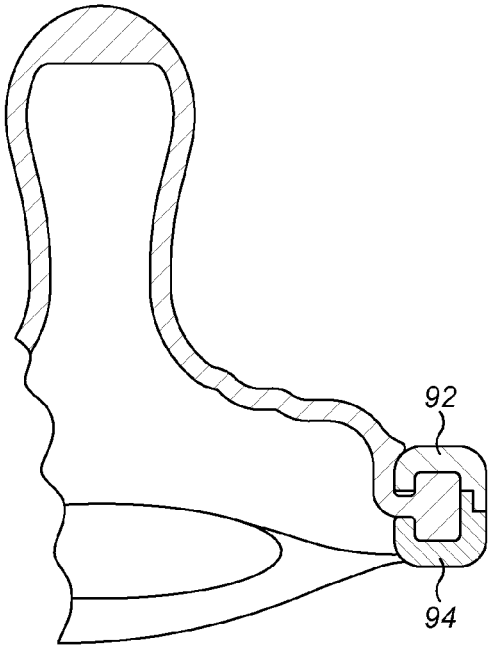

FIG. 9*c* shows a possible configuration of the shield cap and shield of the teether of FIG. 9*a;*

Figure 9D:
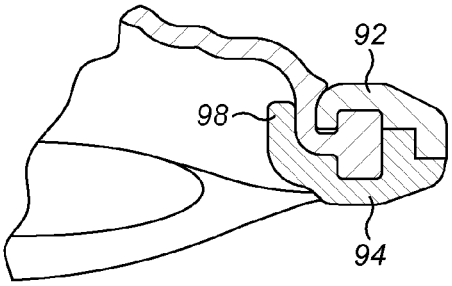

FIG. 9*d* shows an alternative configuration of the shield and shield cap of the teether of FIG. 9*a;*

Figure 10:
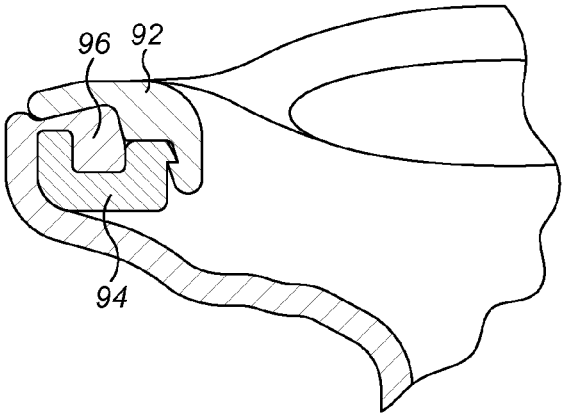

FIG. 10 shows an alternative embodiment of a three-part teether.

OVERVIEW

In overview, a teether is provided that enables an infant to obtain biting and chewing relief for gums during various stages of teeth development. In particular, the teether enables relief for gums at the back of the mouth without being impeded by the infant's front teeth that have already developed. This is achieved by providing a teether having a substantially U-shaped teething surface in which an area corresponding to the infant's front teeth is resiliently collapsible. As a result of this, the teether can be used for young infants in which the front teeth have not yet been cut, since an accessible, biteable surface is provided across the entire U-shape. The same teether can also be used at later stages of infant development, when the front teeth have already grown into place, since the presence of the front teeth can cause the collapsible area at the centre of the U-shape to collapse, hence not preventing the infant from biting down at the back of the mouth where tooth cutting is still in progress.

DETAILED DESCRIPTION

Figure 1:
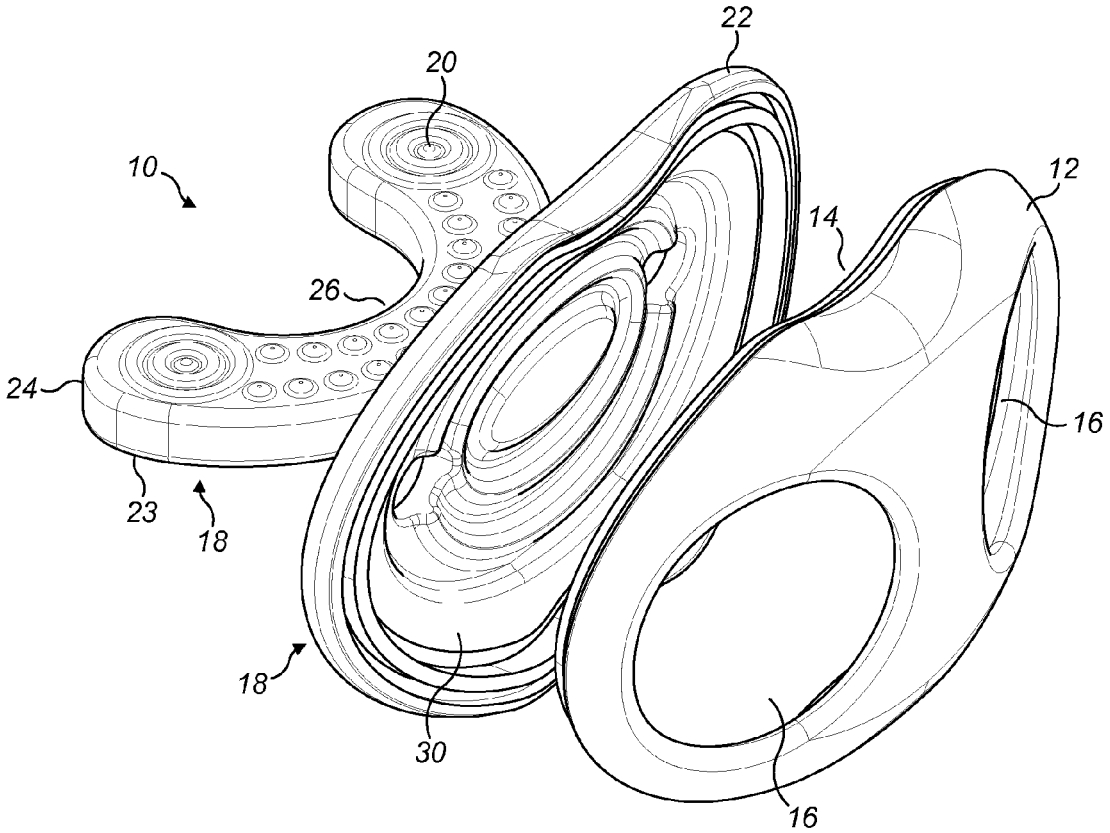
FIG. 1 is an exploded view of a two-part teether, according to an embodiment.

FIG. 1 shows an exploded view of a teether, according to an embodiment. As can be seen from FIG. 1, the teether 10 embodiment is constructed from two parts. The first part is a cap 12 which, in use, remains outside the infant's mouth. The purpose of the cap 12 is to ensure that the teether 10 fits against the infant's lips without a risk of entering the mouth and causing a choking hazard. The cap 12 shown in FIG. 1 is a rigid plastic cap made of an appropriate plastic such as polypropylene (PP). However any suitable material may be used for the cap 12. The cap 12 shown FIG. 1 has a generally rounded or elliptical outer perimeter with a dip 14 along the upper edge, to accommodate the infant's nose and improve comfort during use of the teether 10.

It is preferable to include as little rigid material in a teether 10 as possible, to minimise hardness against an infant's face. However, this must be balanced with the need to provide a sufficiently safe teether arrangement, which will not collapse into an infant's mouth, which would present a substantial safety hazard. The cap 12 shown in FIG. 1 has rigid plastic in a generally figure of eight configuration with two holes 16 at either side of the longitudinal central axis, in which holes 16 there is no rigid material present. There is rigid material along the central longitudinal axis to provide support for the teether 10 as a whole.

The second part of the teether 10 as shown in FIG. 1 is a mouthpiece 18 comprising a substantially U-shaped biting section 20, a relatively rigid support ring 22 and a flexible membrane 30 extending between the support ring 22 and the U-shaped biting section 20. The flexible membrane 30 extends from the perimeter of the support ring 22, and merges into the U-shaped biting section 20. The U-shaped biting section extends generally transversely to the plane of the flexible membrane 30 and relatively rigid support ring 22, in the direction of the central axis of the teether 10. The U-shaped biting section 20 is designed to fit the profile and shape of an infant's gums, wherein the U-shaped biting section 20 has two curved arms 23 with rounded outer edges 24, which arms 23 meet at a central portion 26, which is in the vicinity of an infant's front teeth and gums when in use.

The relatively rigid support ring 22 is sized so as to fit together with the rigid plastic cap 12. The mouthpiece 18 and rigid cap 12 may be assembled together by any suitable means, for example using ultrasonic welding of the support ring 22 and the cap 12.

The mouthpiece itself as shown in FIG. 1 is manufactured in two stages. In a first stage, the relatively rigid support ring 22 is injection moulded. The support ring 22 may be formed of any suitably rigid material, for example polypropylene (PP). In a second stage, flexible material is over moulded to create the flexible membrane 30 and U-shaped biting section 20. Any suitable flexible material may be used, for example thermoplastic elastomer (TPE). The outer periphery of the flexible membrane 30 is fixed to the rigid support ring 22.

Figure 2:
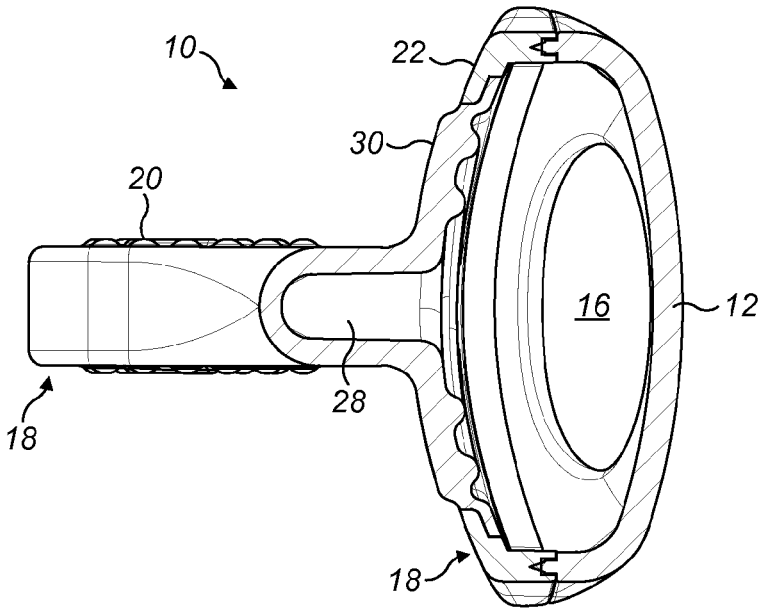
FIG. 2 is a side view of the teether according to FIG. 1, with a cross-sectional view through the neck and cap.
Figure 3:
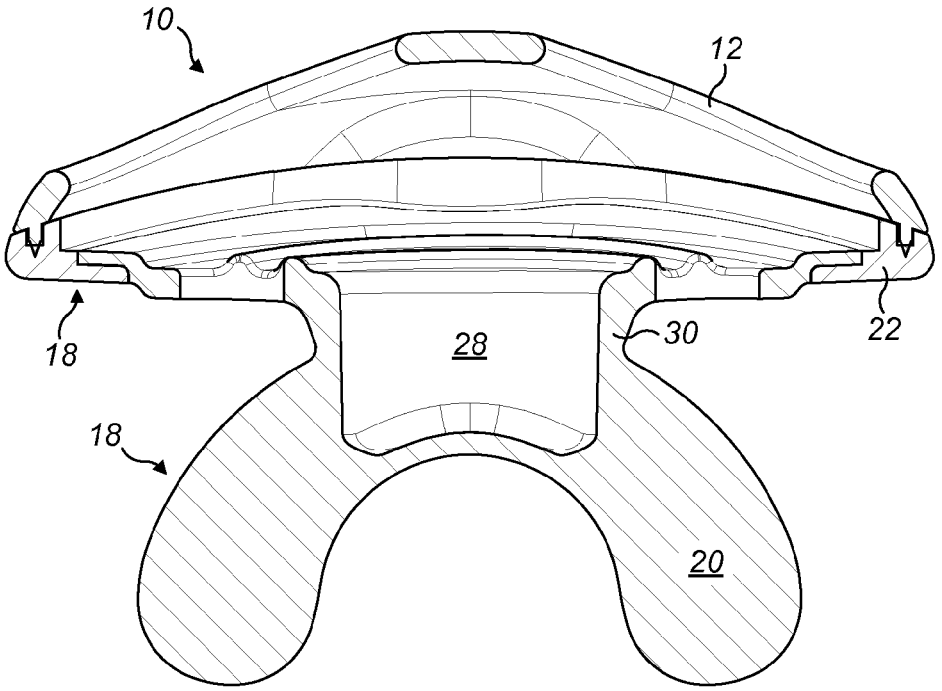
FIG. 3 is a top view of the teether according to FIG. 2.

As can be seen from FIGS. 2 and 3, the mouthpiece 18 includes a neck 28 which extends inwardly from the flexible membrane 30, into the central portion 26 of the U-shaped biting section 20. The neck is formed from the same relatively flexible material which makes up the flexible membrane 30 and the U-shaped biting section 20. Preferably, the flexible membrane 30, neck 28 and substantially U-shaped biting section 20 comprise a continuous formation of flexible material.

In order to provide collapsibility of the central portion 26 of the U-shaped biting section 20, the neck 28 is cored out so that at least part of it is hollow. The remainder of the flexible material comprised within the mouthpiece 18 is solid. Although the neck 28 is made from relatively flexible material, it is still sufficiently rigid and self-supporting that it does not cave in on itself when no force is applied thereto. Instead, the neck 28 is arranged so that a biting force or other compression from infant teeth or gums will cause the neck 28 to flatten out in response to that force. When the force is released, the neck 28 returns to its unflatened configuration for future use. Therefore it is resiliently collapsible. In use, the central portion 26 of the U-shaped biting section 20 may be collapsed or compressed to varying degrees, dependent on the extent of development of the infant's front teeth and the force with which the infant bites or presses down thereon, and returned to its original configuration when the force is removed therefrom.

In order to provide flexibility and enhanced infant comfort, the relatively flexible material of the flexible membrane 30 preferably extends from the periphery of the support ring 22, and continues therefrom to form the U-shaped biting section 20 of the mouthpiece 18. The relatively rigid material of the support ring 22 does not touch the infant's face in such an embodiment. This arrangement ensures maximum comfort for the infant as the flexible membrane 30 of soft material is the only region to contact the infant's face in use. In addition, the flexible membrane 30 provides a "flex and stretch" effect which enhances infant comfort and serves to accommodate the natural movement of an infant's mouth during use of the teether. This "flex and stretch" effect is further described with respect to soother embodiments in earlier patent application number WO 2007/028971, in the name of Jackel International Limited. As can be seen from FIG. 2 of the present application, the flexible membrane 30 may include undulating portions and may include features such as grooves or flex channels.

The flexible material extending from the support ring 22 may be attached in any suitable manner. For example it may be clamped between the support ring 22 and the rigid cap 12, or may be ultrasonically welded to the support ring 22, or it may be adhered to the support ring using known over-moulding techniques.

Whilst FIGS. 2 and 3 show only the neck region as being hollow, it is possible to extend the hollowness into the arms of the U-shaped biting section 20 in order to increase the region of releasable collapsibility of the mouthpiece 18. Such an arrangement serves to enhance the usability of the teether for infants at various stages of teething development, since it accommodates teeth growth into the mouth, towards the rear, as well as teeth growth at the front of the mouth, whilst still allowing the infant to apply biting pressure on the teether on the vicinity of the rear gums. There may be one continuous hollow region, or several distinct hollow regions in the flexible material of the U-shaped biting section 20.

FIG. 4*a* shows a plan view of just the flexible material of the mouthpiece part of a similar teether to the teether 10 shown in FIG. 1. The teether 40 in FIG. 4*a* comprises a layer of material or flexible membrane 42 extending from a substantially U-shaped flexible mouthpiece 44. The mouthpiece 44 includes a textured surface, as discussed further below.

FIG. 4*b* shows a cross-section of an embodiment of the teether shown in FIG. 4*a* across the line designated AA therein. In this embodiment, the mouthpiece 44 includes an inner cavity 50 defined by a surface which includes upper 46 and lower 48 walls. The walls 46, 48 are collapsible about the cavity 50, as described with respect to earlier embodiments herein. The cavity 50 in this embodiment is generally rectangular in cross-section, as can be seen from FIG. 4*b*, with the upper 46 and lower 48 walls extending substantially parallel to the upper and lower biting surfaces of the relatively flexible mouthpiece 44. If the teether is being used by a child or infant who already has their first teeth, when they bite down on the mouthpiece portion 44 shown in FIG. 4*b* they will be pressing down against a substantially uniform surface, due to the rectangular cross-sectional shape of the cavity 50. As a result there will be little or no point pressure, which is advantageous for the durability of the teether 40. This generally rectangular cross-section of cavity 50 has a further advantage in that it is relatively easy to design and manufacture.

Other cavity shapes are also possible for teethers such as the one shown in FIG. 4*a*. These are discussed in detail with reference to FIGS. 4*b* to 8 below. As will be understood from the following detailed description, altering the shape of the cavity inside the mouthpiece of a teether and/or the profile of the surface defining the cavity can assist with enhancing the collapsibility of the flexible mouth piece portion whilst not causing particular problems for the teeth. As the skilled reader will be aware, teethers and soothers are often sold in "stages" so that the child can use something appropriate for each stage of their development. Altering the internal shape of a teether as described in detail below enables the manufacturer to tailor products in order to cater for various stages of development, for example to cater for the increasing number of teeth that a child will have over time.

FIG. 4*c* shows an alternative embodiment wherein the cavity 52 in the mouthpiece 44 is rounded in cross-section. For example, it could be substantially circular, oval or elliptical. By creating a rounded shape of cavity, the surface area of the surface defining the cavity is reduced. This can be beneficial during manufacture since a rounded shape will encounter less drag when the flexible baglet material of the mouthpiece is being removed from the moulding tool after moulding. A further advantage of a rounded cavity shape is that the collapsible walls above and below the cavity are thinner in the middle. As a child grows it will generally start getting teeth from the centre of the mouth outwards, therefore a teether such as the one shown in FIG. 4*c* will be beneficial to an infant having only a few teeth, for example two incisors at the top and two at the bottom, in the centre of their mouth.

According to other variations, it is possible to make the cavity inside the relatively flexible mouthpiece of a teether asymmetric, to account for children whose top and bottom teeth do not develop at the same rate. The embodiments described herebelow include particular features in the lower section of the flexible mouthpiece but not in it upper section, but such features could be provided in the top and/or bottom sections of the teether without departing from the concepts embodied by the particular arrangements described herein. By providing a series of features on the bottom collapsible wall as shown in the soothers of FIGS. 4*d* and 4*e*, the teether enables the infant or baby to teethe on its top gums even though its first bottom teeth have already come through. If the features were repeated on the top collapsible wall above the cavity, the baby could teethe, i.e. soothe its gums, away from the centre of the mouth once its first incisors have come through.

In the embodiment shown in FIG. 4*d* an arrangement of grooves is provided on the surface defining the cavity 54. The cavity 54 in the mouthpiece 44 is substantially rectangular in cross-section except in the vicinity of the grooves 56. The grooves 56 are on the bottom wall below the cavity and extend downwards therefrom. The grooves 56 shown in FIG. 4*d* are substantially rectangular in cross section when the teether is in a non-compressed state.

In the arrangement shown in FIG. 4*d* the grooves 56 act so that, when a compressive force is applied to the upper and lower biting surfaces of the mouthpiece 44, the lower wall at the base of the cavity 54 can move downwards by stretching the thin regions of the relatively flexible material at the base of the grooves 56 and/or by compressing or expanding in the space in between the grooves 56. FIG. 4*e* shows the teether of FIG. 4*d* after slight compression, for example by application of a biting force in the central region by a child's first two bottom teeth. As can be seen therein, the grooves have deformed as a result of the compressive force but will relax back to their original shape as shown in FIG. 4*d* once the compressive force is removed.

Any suitable shape or profile of grooves may be provided on or in a surface defining a cavity within the mouthpiece of a teether, in accordance with manufacturing and operational requirements for the teether. Furthermore, although three grooves are shown in FIGS. 4*d* and 4*e*, any number of grooves may be provided in the surface defining the cavity within the flexible mouthpiece of a teether.

FIG. 4*f* shows an alternative embodiment wherein, instead of a series of distinct grooves in the surface which defines a cavity within the mouthpiece portion of a teether, the lower wall which defines the base of the cavity has a continuous "stepped" or undulating profile. The step can be arranged as shown in FIG. 4*f* so that the thinnest and therefore most collapsible material is provided in the centre of the teether, which is the region most likely to be pressed by a baby's first teeth, and the thickest and therefore least collapsible material is provided towards the edges of the cavity, towards the sides of the baby's mouth, which are less likely to have teeth at an early stage of the baby's development.

FIG. 5*a* shows an alternative embodiment wherein the cavity 54 is not fully contained within the baglet material which forms the mouthpiece portion of the teether. Instead, there are a series of slits 60 extending downwardly from the main body of the cavity, extending right through the lower biting surface of the flexible mouthpiece 44. If a compressive force is applied to the teether shown in FIG. 5*a* by an infant, the slits 60 can readily be pressed by the infant's bottom teeth in regions where teething has already occurred, where the soothing and massaging effect of a teether is thus no longer required. At the same time, the flat surface offered by the continuous upper wall of the surface which defines the cavity will be unaffected by the presence of the slits in the lower wall and thus the teether will offer a continuous surface on which the baby can teethe, i.e. apply force to its gums, in upper regions of the mouth where it may still be needed. The slits 60 do not have to be through the lower biting surface of the flexible mouthpiece 44 of the teether, they could instead be through the upper biting surface.

FIG. 5*b* shows a view from beneath of the teether as shown in FIG. 5*a* with the slits 60 therein.

In the embodiment shown in FIGS. 5*a* and 5*b*, the extent to which the upper and lower walls which define the cavity 54 inside the flexible mouthpiece can be compressed does not depend solely the size or shape of the cavity but also on the ability of the material between the slits 60 to stretch and elongate. Again, the dimensions of the "baglet" material which forms the flexible mouthpiece can be tailored to allow the appropriate amount of compressibility and movement of the mouthpiece, dependent on the age and stage of infant for which the teether is designed. For example, slitting a relatively thin material will allow material between the slits to deflect more than material between slits of relatively thick material and longer slits will allow the material in between to have more movement than material in between shorter slits would have.

Although three slits are shown in each of FIGS. 5*a* and 5*b*, any number of slits may be provided right through the biting surface or surfaces defining the cavity within the flexible mouthpiece of a teether.

FIG. 6 shows an alternative embodiment including grooves 62 formed on the lower biting surface of the mouthpiece of a teether. As the skilled reader will appreciate, the grooves 62 can perform a similar function to the grooves described above with respect to FIG. 4*d*. The compression or expansion of the flexible material in the vicinity of the grooves can enhance teething effects for the teether.

FIG. 7 shows a further alternative where grooves are provided on both the inner surface which defines the cavity and the outer biting surface of the relatively flexible mouthpiece. The grooves can be aligned with one another as shown in FIG. 7 or, alternatively, they can deliberately be out of alignment with one another as shown in FIG. 8. The size, shape and number of these grooves, as well as their positions, can be tailored according to the age and stage of child for which the teether is designed, taking into account other factors such as the material to be used for the mouthpiece and so on.

As an alternative, thickening ribs may be provided on the inner and/or outer surfaces of the upper and/or lower biting portions surrounding a cavity in the mouthpiece of a teether. The thickening ribs can be arranged so that they reduce collapsibility in certain regions of the teether whilst allowing other regions of the teether, which do not include thickening ribs and which may or may not include grooves or recesses therein, to flex easily and thus be more pliant than the thickened rib portions.

It is also possible to have thickening ribs on the inner surface which define a cavity within a teether. Such ribs can be provided with complementary grooves or recesses on an opposing side of the surface which defines the cavity. With such an arrangement, when a force is applied to the biting surfaces of the teether to press them together, for example when a child with incisors bites the teether, the strengthening ribs fit into the grooves or recesses and the child's gums will not feel unevenness or point pressure.

In all the teether embodiments described above, the U-shaped biting section 20 of the mouthpiece 18 may comprise any suitable surface texture. For example, as shown in FIGS. 1 and 4*a*, there may be a series of raised portions on the upper and/or lower surface of the U-shaped biting section, to provide a massage effect when an infant bites down thereon. Furthermore, towards the outer edges of the U-shape, in the vicinity of the rear teeth when the teether is in use, a series of concentric grooves may be provided to provide a soothing or massage effect when the infant bites down thereon.

Whilst the teether has been described as having a rigid plastic cap it will be appreciated that any suitable rigid formation on the outer of the teether may be used. It may include a handle for easier removal and insertion of the device. The outer cap may be slightly domed, as shown in FIG. 1, or may be substantially flat. The rigid cap itself may also be covered, in full or in part, with a flexible membrane.

Whilst a two part construction has been described herein, any suitable construction method may be used. The flexible mouthpiece material, the support ring and the outer cap may be made as a single entity, or may be manufactured in three or more parts and assembled together in any suitable manner.

Alternative Construction

Instead of manufacturing a teether in two parts as described above, it can be moulded as three separate parts as shown in FIGS. 9*a* to 9*d* herein. The three part teether shown in FIGS. 9*a* to 9*d* includes a cavity in the central section of the relatively flexible mouthpiece portion, as has been described in detail hereabove. However it is also possible for a three part soother to be constructed substantially as shown in FIGS. 9*a* to 9*d* and described herebelow, but without a cavity in the mouthpiece portion.

The three separate parts in such an arrangement are a shield 92, a shield cap 94 and a flexible mouthpiece 96. The shield 92 and shield cap 94 are relatively rigid whilst the mouthpiece 96 is relatively flexible and soft. In the embodiments shown in FIGS. 9*a* to 9*d* the outer perimeter of the membrane which forms the flexible mouthpiece 96, extending between the U-shaped portion of the mouthpiece towards the relatively rigid portions of the teether, is mechanically trapped between the shield 92, which can also be referred to as a ring, and the shield cap 94, which can also be referred to and act as a handle. Once the flexible membrane has been trapped between the shield 92 and the shield cap 94, the shield 92 and shield cap 94 are permanently joined together by a suitable method such as permanent ultrasonic welding. As can be seen from the closer view of FIG. 9*b*, the membrane should ideally be mechanically trapped or clamped in at least two directions between the shield 92 and shield cap 94. Although only a cross-section of the shield 92 and shield cap 94 are shown in FIGS. 9*a* and 9*b*, it will be appreciated that clamping of the membrane therebetween continues for the entire perimeter of the membrane, not just the particular points visible in FIGS. 9*a* and 9*b*. It is essential to trap the membrane sufficiently in order to avoid the risk of it becoming loosened from the relatively rigid portions of the teether, in order to avoid a choking hazard for the infant.

In the embodiment shown in FIGS. 9*a* and 9*b* the shield 92 or at least a portion thereof rests against the face of an infant or child using the teether. The shield cap 94 on the other hand forms the outer most surface of the teether and therefore does not come into contact with an infant's face during use of the teether. FIGS. 9*c* and 9*d* show in some more detail two possible profiles for the shield 92 and shield cap 94. The surface of the shield 92 may be substantially flat against an infant's face as shown in FIG. 9*c*. Alternatively, it may be profiled away from the infant's face towards the outer edges of the teether, as shown in FIG. 9*d*.

As shown in FIG. 9*d*, a supporting rim 98 may be provided on the shield cap 94. The supporting rim 98 extends along a portion of the lower surface of the mouthpiece, in the vicinity of the outer perimeter of the relatively flexible membrane. The supporting rim 98 therefore supports the perimeter of the mouthpiece while being shielded from the child's face.

FIG. 10 shows an alternative embodiment wherein the soft material of the flexible mouthpiece 96 covers the shield 92 in regions of the teether that come into contact with an infant's face. The relatively flexible material is plugged or trapped between the shield 92 and the shield cap 94 as described above with respect to FIGS. 9*a* and 9*b* but extends outwardly from the region in which it is trapped, hence wrapping over the shield 92 and thus providing a soft flexible surface which will come into contact with an infant's face during use of the teether.

In the embodiments shown in FIGS. 9*a* to 10 the portion of flexible material trapped between the shield and shield cap is substantially square in cross-section, however, any suitable cross-section of trapped material may be provided. As shown in FIGS. 9*a* to 10, it is useful to provide a narrow channel extending away from the region in which the flexible membrane is trapped, so that it is particularly difficult for the trapped mass of flexible material to extend through that channel and thereby be pulled out of the rigid members of the teether. As shown particularly in FIG. 10, as well as being welded together, the shield and shield cap may fit together by a clip fixing or other suitable inter-engagement means, in order to further fortify the structure of the teether. In the embodiments shown, there is no need for any pins or other additional components in order to trap the baglet membrane within the rigid parts of the soother. Instead, the rigid parts can be generally located over one another and welded or otherwise fixed together in order to secure the baglet material therein.

Variations

Whilst the biting portion of the teether has been described as being substantially "U-shaped", it will be appreciated that any suitable shape which accommodates the profile of an infant's teeth and gums may be used. The purpose of the biting section is to provide a surface area in the mouth on which the infant can press down during teething, whilst at the same time fitting comfortably inside the infant's mouth and not posing any choking hazard or other safety risk. Therefore it is important that the biting section is connected securely to the rigid outer portions of the teether, which themselves should be sufficiently hard and large that they cannot be swallowed or inhaled.

In the embodiments described the collapsibility of certain portions of the U-shaped biting section is achieved by providing hollow, and hence compressible, formations of relatively flexible material therein. It will be appreciated that resilient or releasable collapsibility of portions of the teether may be achieved in other ways, for example by using a region of solid material of a different softness, having suitable elastic properties, in order to collapse and reform as appropriate during use. Alternatively or additionally, the formation may be only partially hollow, and/or may have supporting ribs to assist in the resilient compression and decompression of the formation. Alternatively or additionally, the formation may be cored out and have a sponge-like material therein, to assist with collapsing and reforming of the collapsible region of the mouthpiece. The hollow or compressible portions may be provided in any suitable portion of the flexible membrane which forms the mouthpiece of a teether—not just in the central portion or arms of a substantially U-shaped mouthpiece as described in detail herein.

Whilst a substantially U-shaped teether has been described herein, other teether shapes are possible without departing from the inventive concepts embodied in the particular arrangements shown and described herein. For example, a teether which includes discontinuities or gaps to accommodate an infant's teeth in certain regions of the mouth may be provided.

Whilst the methods of construction described herein have been applied to teethers, it will be appreciated that the same methods could be used to construct a soother in two or three parts. Like a teether, a soother comprises a relatively flexible portion or membrane which is trapped by and extends from one or more relatively rigid portions as described in detail hereabove. The relatively flexible portion in a soother is not used for teething but instead comprises a mouthpiece for an infant to suck on, to soothe the infant.

Hence a teether is provided which provides comfort and relief for an infant during various stages of teething. The infant can press down on the biting surface and the region of the teether located between the infant's front teeth or gums will collapse to a desired extent, so that biting and chewing pressure can be felt by the gums at the rear of the mouth, where the teeth are less developed. The teether is provided in a simple construction, using a minimal number of parts and avoiding very small parts that could pose a choking hazard. Preferably, the teether provides a soft, flexible surface next to the infant's skin, for enhanced comfort and accommodation of typical mouth movements during use. The teether can be constructed using a variety of techniques, in a straightforward, efficient and cost-effective manner.

The invention claimed is:

1. A teether for infant use, the teether comprising an exterior portion, a mouthpiece comprising a first region of flexible material and a second region of flexible material, and a support ring provided intermediate the mouthpiece and the exterior portion, wherein the mouthpiece further includes a substantially continuous U-shaped biting section comprising solid first and second arms in the second region of flexible material extending from a central portion in the first region of flexible material, wherein at least part of the central portion is resiliently collapsible upon application of pressure thereto during use of the teether by an infant, and wherein the first region of flexible material is more collapsible than the second region of flexible material.

2. A teether as claimed in claim 1 wherein at least part of the central portion of the substantially continuous U-shaped biting section is hollow to provide said resilient collapsibility.

3. A teether as claimed in claim 1, wherein the support ring secures the mouthpiece to the exterior portion of the teether.

4. A teether as claimed in claim 3 wherein the substantially U-shaped biting section is formed from the first region of flexible material and the second region of flexible material, and the support ring is formed from a rigid material, wherein the first region of flexible material and the second region of flexible material are more flexible than the rigid material of the support ring.

5. A teether as claimed in claim 1 further comprising a layer of flexible membrane extending between the exterior portion and the substantially U-shaped biting section wherein the flexible membrane forms a surface of the teether against an infant's face during use of the teether.

6. A teether as claimed in claim 5 wherein the layer of flexible membrane includes at least one undulating portion.

7. A teether as claimed in claim 1 wherein the substantially U-shaped biting section further comprises an external texture.

8. A teether as claimed in claim 1 wherein the first region of flexible material has a different softness than the second region of flexible material to be more collapsible in use.

9. A teether as claimed in claim 1 wherein the substantially U-shaped biting section is formed from the first region of flexible material and the second region of flexible material, and the exterior portion is formed from a rigid material, to prevent collapse of the teether as a whole, wherein the first region of flexible material and the second region of flexible material are more flexible than the rigid material of the exterior portion.

10. A teether as claimed in claim 9 wherein the exterior portion includes at least one hole in which none of the rigid material is present.

11. A teether as claimed in claim 2 wherein the hollow part of the central portion of the substantially U-shaped biting section is defined by a surface having at least one groove therein.

12. A teether as claimed in claim 2 further comprising one or more slits extending from the hollow part of the central portion and through a wall of the central portion to an outer surface of the wall.

13. A teether as claimed in claim 2 further comprising at least one groove or recess in an outer surface of the central portion of the substantially U-shaped biting section.

14. A teether as claimed in claim 5 wherein a portion of the layer of flexible membrane is clamped between the exterior portion and the support ring of the teether.

15. A teether as claimed in claim 2 wherein the cavity has a rectangular cross-section.

16. A teether as claimed in claim 2 wherein the cavity has an oval cross-section.

17. A teether as claimed in claim 2 wherein the cavity has a symmetrical cross-section.

18. A teether as claimed in claim 2 wherein the cavity has an asymmetrical cross-section.

19. A teether as claimed in claim 2 wherein a periphery of the cavity includes grooves.

20. A teether as claimed in claim 2 wherein a periphery of the cavity includes continuous stepped portions.

21. A teether as claimed in claim 2 wherein the teether further comprises at least one opening between the cavity and the lower surface of the mouthpiece.

22. A teether as claimed in claim 2 wherein the teether further comprises at least one opening between the cavity and the upper surface of the mouthpiece.

23. A teether comprising:

a mouthpiece comprising a u-shaped biting portion having a top surface, and a bottom surface, wherein a first region of the u-shaped biting portion includes a cavity extending between a portion of the top and bottom surfaces, and at least part of a second region of the u-shaped biting portion includes two solid arms, a neck having a first end connected to the u-shaped flexible mouthpiece and a second end connected to a flexible membrane having an outer periphery; and a rigid cap;

wherein the outer periphery of the flexible membrane is sized to mate with the rigid cap; and wherein the outer periphery of the flexible membrane is over moulded to the rigid cap.

24. The teether of claim 23 wherein the u-shaped biting portion, neck and flexible membrane are a unitary piece.

25. A teether comprising:

a mouthpiece comprising a flexible u-shaped biting portion having a top surface, and a bottom surface, wherein a first region of the flexible u-shaped biting portion includes a resiliently collapsible cavity extending between a portion of the top and bottom surfaces, and at least part of a second region of the flexible u-shaped biting portion includes two arms having a solid construction, a neck having a first end connected to the u-shaped flexible mouthpiece and a second end connected to a flexible membrane having an outer flanged periphery;

a rigid shield; and a rigid shield cap;

wherein the rigid shield is sized to mate with the rigid shield cap;

wherein the outer flanged periphery of the flexible membrane is trapped between the rigid shield and the rigid shield cap; and wherein the rigid shield and rigid shield cap are fixed together.

26. A teether comprising:

a cap and a flexible U-shaped mouthpiece for conforming to the shape of the gums of an infant, the flexible U-shaped mouthpiece including a central portion and first and second arms extending from the central portion and defining an open area between the first and second arms adapted to receive an infant's tongue;

the flexible U-shaped mouthpiece being a continuous formation of flexible material having a continuous upper surface that is flat at the central portion;

the first and second arms having a solid construction and having upper and lower surfaces which are textured; and the central portion of the flexible U-shaped mouthpiece includes upper and lower walls with a cavity positioned between the upper and lower walls with the upper and lower walls being resiliently collapsible about the cavity.

27. The teether of claim 26 wherein an inner surface of one of the upper and lower walls of the central portion defining the cavity includes at least one groove.

28. A teether comprising:

an exterior portion;

a u-shaped mouthpiece including solid first and second arms extending from a central portion; and a flexible membrane connecting the mouthpiece to the exterior portion;

wherein the central portion is more collapsible than the first and second arms.

29. A teether comprising:

a cap connected to a u-shaped mouthpiece;

the mouthpiece including two curved arm portions extending from a central portion and defining an open space therebetween for conforming to the gum line of a child;

the two curved arm portions having a solid construction and the central portion being resiliently collapsible to a greater degree than the two curved arm portions;

the central portion including a cavity between upper and lower walls of the mouthpiece; and wherein the upper wall at the central portion has a continuous flat surface.

* * * * *